US007818828B2

(12) United States Patent
Zhou

(10) Patent No.: US 7,818,828 B2
(45) Date of Patent: Oct. 26, 2010

(54) MULTI-FUNCTIONAL SHOWER HEAD

(76) Inventor: Hua-Song Zhou, Room 704, No. 135, Hubin S, Rd., Xiamen, Fujiang (CN)

( * ) Notice: Subject to any disclaimer, the term of this patent is extended or adjusted under 35 U.S.C. 154(b) by 920 days.

(21) Appl. No.: 11/225,459

(22) Filed: Sep. 13, 2005

(65) Prior Publication Data

US 2007/0056090 A1 Mar. 15, 2007

(51) Int. Cl.
*A47K 3/22* (2006.01)
*A47K 3/34* (2006.01)
*A47K 3/36* (2006.01)

(52) U.S. Cl. ..... 4/615; 4/567; 4/601; 137/883

(58) Field of Classification Search ..... 4/567, 4/568, 601, 615–618, 675–677; 239/463, 239/397, 390, 381, 383, 240, 223, 222.11, 239/436, 443, 444, 447; 137/883
See application file for complete search history.

(56) References Cited

U.S. PATENT DOCUMENTS 5,433,384 A * 7/1995 Chan et al. ..... 239/449
5,862,985 A * 1/1999 Neibrook et al. ..... 239/99
6,367,710 B2 * 4/2002 Fan ..... 239/99
7,114,666 B2 * 10/2006 Luettgen et al. ..... 239/463

* cited by examiner

*Primary Examiner*—Tuan N Nguyen
(74) *Attorney, Agent, or Firm*—Banger Shia

(57) ABSTRACT

A switching mechanism for a multi-function shower head is mounted inside of a shower head body and coordinates with a water pressure relief valve, including a curbing ring, a dividing disk, an under-driving gear set, an impeller, a transferring stand, a drawbar, a blocking and a top cap; with the transferring stand disposed on the top, and an outlet and a diagonal outlet at bottom of the shower head body; the top cap possesses a joint port; the drawbar is inserted into the tubing, and a restoring spring is set between said end cover and the outside end of the drawbar; a thimble is placed inside of the drawbar.

2 Claims, 8 Drawing Sheets

MULTI-FUNCTIONAL SHOWER HEAD

BACKGROUND OF THE INVENTION

1. Field of the Invention

The present invention relates to a multi-functional shower head, and more particularly to a switching mechanism of shower head.

2. Description of Prior Art

In conventional technology, the multi-functional shower heads come in many different varieties, in which the switching mechanisms with multiple functions are all designed very differently. But, until so far, in variant shower heads, the switching mechanism shifting each function is combined into the main body, by turning one component (just like outlet disk and so on) selecting desired nozzles open carries out this spray mode.

For some conventional shower heads, when it comes to switching the shower head the head has to be taken down from where it is hanged, and held in hand for a user to operate a desired mode; the operation is thus inconvenient, especially for a shower head of a large size (such as 8 inches and more spray disk), since extra effort is required; as regards positioned shower heads, they are usually located at a higher position over the head of the user, so the operation is more inconvenient, especially to the shorter users, the position of the adjusting component is so high that they can not get to operate; and for suiting to the change of the spraying angle, a ball spherical joint attached between the outlet of pipe and the shower head is employed in coming goods, in this case, as switching the spray mode, due to poor resistant torsion of the spherical joint, switching operation is usually failed with one hand, hence in common situations both hands are needed to operate the switching mechanism; on the other hand, frequent use of the switching component located on surface of the main body of the shower head can easily cause adjacent components of the switching mechanism to be loosen, further affecting the waterproof performance.

OBJECTS AND SUMMARY OF THE INVENTION

It is therefore a main object of the present invention to provide a switching mechanism of multi-function shower head with a simple structure, which is easy to operate, and waterproof.

To achieve the above-mentioned object, the present invention provides a switching mechanism of a multi-function shower head; the switching mechanism is mounted on the inside of the main body of the shower head, coordinated with a water pressure relief valve set upon the inlet pipe the switching mechanism is typically comprised of a curbing ring, a dividing disk, an under-driving gear set, a impeller, a transferring stand, a drawbar, a blocking and a top cap; said transferring stand covering on the top side of the main body possesses a tubing communication with a housing including an inlet at top side, and a outlet and diagonal outlet at bottom side; said top cap covered on said inlet of the said transferring stand possesses a joint port for connecting to the inlet pipe; said drawbar is inserted into the tubing, and located in by an end cover covering on the outside end of the tubing, and a restoring spring is set upon between said end cover and the out end of the drawbar, a thimble is put on the inside tip end of the drawbar and located on the blocking; the area of the bottom surface of the blocking is bigger than the sum sectional area of the outlet and diagonal outlet so that the blocking can be moved on or off by the high pressure of water or restoring spring to open the diagonal outlet and close the outlet simultaneously, or close the diagonal outlet and open the outlet simultaneously; said impeller is mounted on the bottom side of the transferring stand, and fixed on the prime shaft of the under-driving gear set, meanwhile the blades exactly face to the diagonal outlet; the dividing disk and said curbing ring are simultaneously fastened on a same shaft, and said dividing disk cooperates to a dialing disk fixed on the last shaft of the under-driving gear set to carry out Geneva motion working as indexing mechanism, to drive the curbing ring with proper number of through-holes coordinating to each spray mode nozzles to open one spray mode in proper time; between each pair of adjacent components a sealing ring is set upon for guarantee watertight-ness.

Said end cover is secured on the female threaded outside end of the tubing with the male thread.

In contrast to the above-mentioned structure, the present invention discloses a showerhead switching mechanism of a simple structure and a good waterproof performance, coordinating with the pressure relief valve on the inlet pipe. When in default, the pressure relief valve is turned off, the water pressure is in normal value, the blocking is moved to the housing following the drawbar under the restoring force of the restoring spring so that its bottom surface exactly blocks off the diagonal outlet, simultaneously open the outlet, at this time, water is led into top cap via the inlet pipe, passing through housing of the transferring stand and outlet, the through-holes of the curbing ring and one mode spraying nozzles to spray out in this spray mode. As tending to switching the spraying mode, just need to press the pressure relief valve down to turn it on, the water pressure is increased, the blocking is pressed to drive the thimble move to outside along the tubing under the high water pressure, so that the bottom surface of the blocking slides off the diagonal outlet, simultaneously blocks off the outlet, in this time, water is led into the top cap via the inlet pipe, passing through housing of the transferring stand and the diagonal outlet to shoot on the blades of the impeller exactly to drive the impeller spinning, so as to transfer to the under-driving gear set, via the deceleration of said under-driving gear set and the indexing motion between the dialing disk and the dividing disk, the curbing ring is sequentially and periodically to open each spray mode nozzles so that the shower head sprays out water in variety mode periodically until the pressure relief valve is pressed down again, the high water pressure is took away, the restoring spring pushes the blocking via the thimble to move to the housing of the transferring stand again, so that the bottom surface of the blocking slides off the outlet, simultaneously blocks off the diagonal outlet, the water flow is restored to the original normal state.

In accordance with above-describing, the present invention applies changing the water pressure to switch outlet water flow, instead of the conventional manual change outlet water flow in mechanical switching, so that the shower head does not need to be took off from the holder pedal on the wall, or stretch out the hand to turn the switching component on the hangover shower head, whatever the shower head is big or small, the user just slightly presses down the pressure relief valve mounted on the inlet pipe to turn on or off the high water pressure, the switching process is became so simple and easy. On the other hand, in the present invention, do not need to turn any component on the surface of the shower head, so the watertightness is kept in.

DETAILED DESCRIPTION OF PREFERRED EMBODIMENTS

Figure 1:
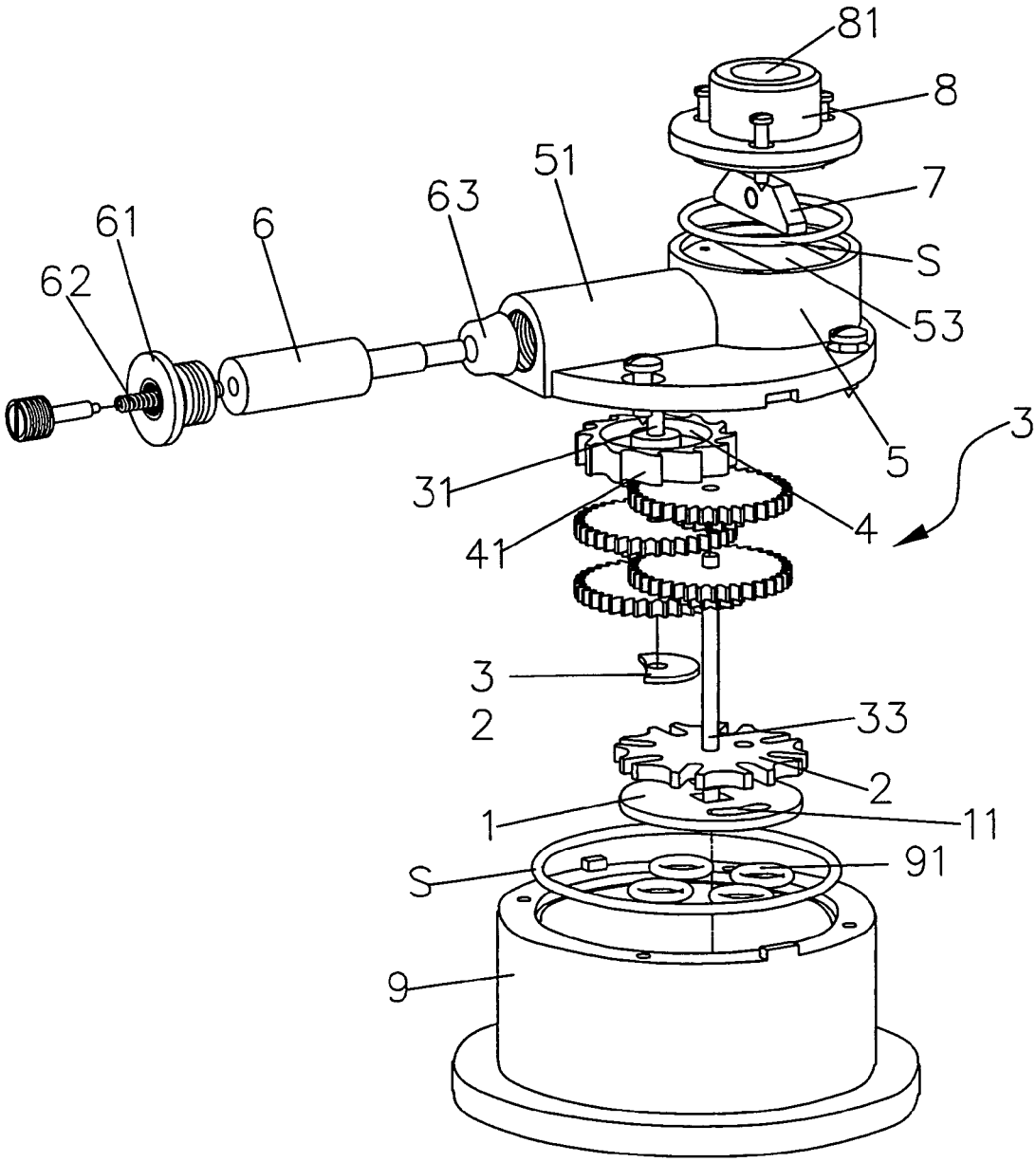
FIG. 1 is an exploded view of the present invention.

Referring to FIG. 1, the present invention provides a switching mechanism for a multi-function shower head; the switching mechanism is mounted inside of the main body 9 of the shower head, coordinated with a water pressure relief valve (not shown in drawings) set upon the inlet pipe (not shown in drawings); said main body 9 of the shower head is integrated with different spraying mode modules (note: the exact structure of each module 91 is not detailed in drawings, but the relative positions of four different modules are shown by the sealing rings S in drawings).

The present invention discloses a showerhead switching mechanism, mainly comprised of a curbing ring 1, a dividing disk 2, an under-driving gear set 3, an impeller 4, a transferring stand 5, a drawbar 6, a blocking 7 and a top cap 8.

Figure 7:
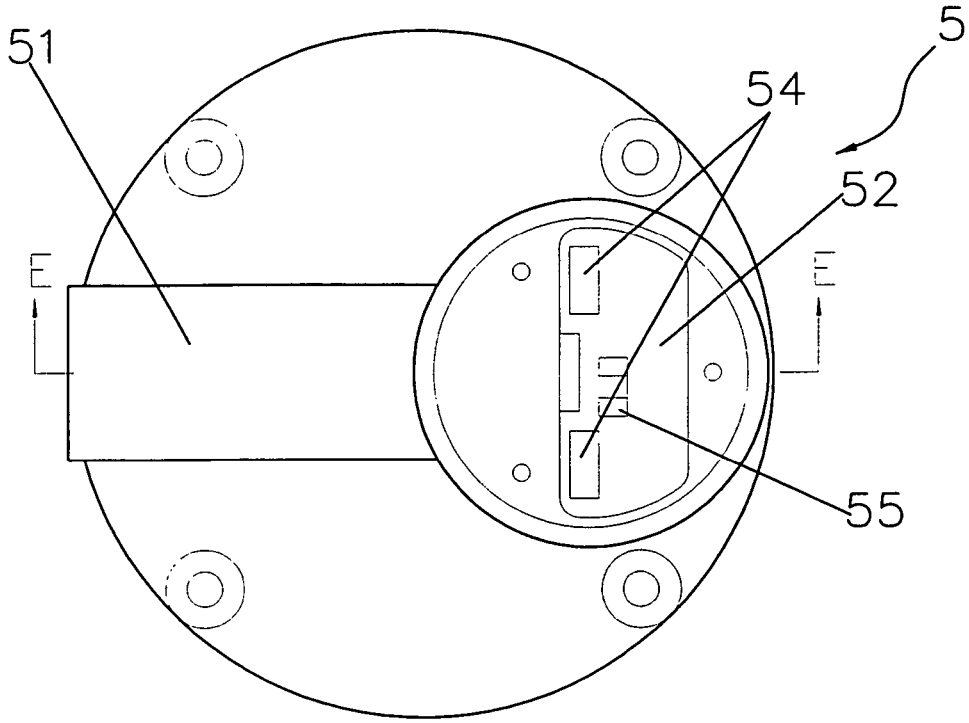
FIG. 7 is a top-side view showing the transferring stand of the present invention.
Figure 8:
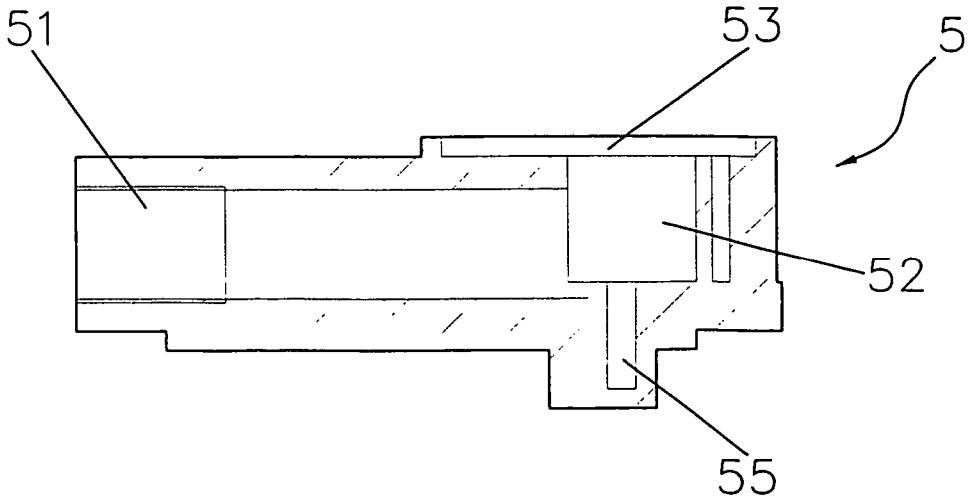
FIG. 8 is a cross-section view showing E-E section of FIG. 7.

Said transferring stand 5 covering the top of the main body 9 (referring to FIG. 7 and FIG. 8); the transferring stand 5 includes a tubing 51 communicating with a housing 52, an inlet 53 at top side, a outlet 54 and a diagonal outlet 55 at bottom side.

Said top cap 8 covered on the inlet 53 of the said transferring stand 5 possesses a joint port 81 for connecting to the inlet pipe (not shown in drawings).

Said drawbar 6 is inserted into the tubing 51, and located in by an end cover 61 covering on the outside end of the tubing 51, and a restoring spring 62 is set upon between said end cover 61 and the out end of the drawbar 6, a thimble 63 is put on the inside tip end of the drawbar 6 and located on the blocking 7 with other end. The area of the bottom surface of the blocking 7 is bigger than the sum sectional area of the outlet 54 and diagonal outlet 55 so that the blocking 7 can be moved on or off by the high pressure of water or restoring spring 62 to open the diagonal outlet 55 and close the outlet 54 simultaneously, or close the diagonal outlet 55 and open the outlet 54 simultaneously (the detail will be described in follows), thereon, the high water pressure is generated by controlling the pressure relief valve mounted on the inlet pipe, because the technology is a conventional, so here is not to describe further.

Said impeller 4 is mounted on the bottom side of the transferring stand 5, and fixed on the prime shaft 31 of the under-driving gear set 3, meanwhile the blades 41 exactly face to the diagonal outlet 55.

Said under-driving gear set 3 is mounted on the main body 9, and a dialing disk 32 is fixed on the last shaft of it.

Figure 4:
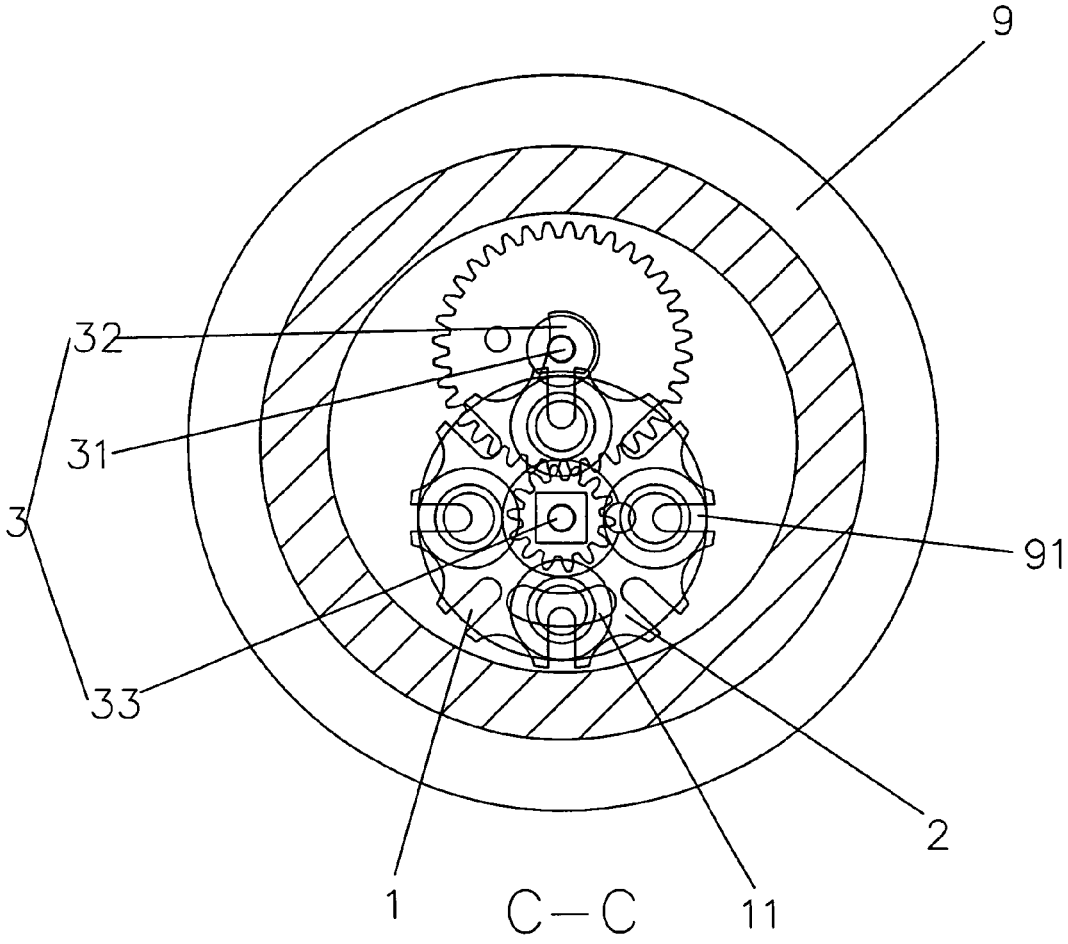
FIG. 4 is a cross-section view showing C-C section of FIG. 2.

The dividing disk 2 and said curbing ring 1 are simultaneously fastened on a same shaft 33, and said dividing disk 2 cooperates to a dialing disk 32 fixed on the last shaft 33 of the under-driving gear set 3 to carry out Geneva motion working as indexing mechanism, as shown in FIG. 4, to drive the curbing ring 1 with proper number of through-holes 11 (below the sealing rings 91) coordinating to each spray mode nozzles to open one spray mode in proper time.

Between each pair of adjacent components in this assembly, a sealing ring S is set upon for guarantee watertight-ness.

Figure 2:
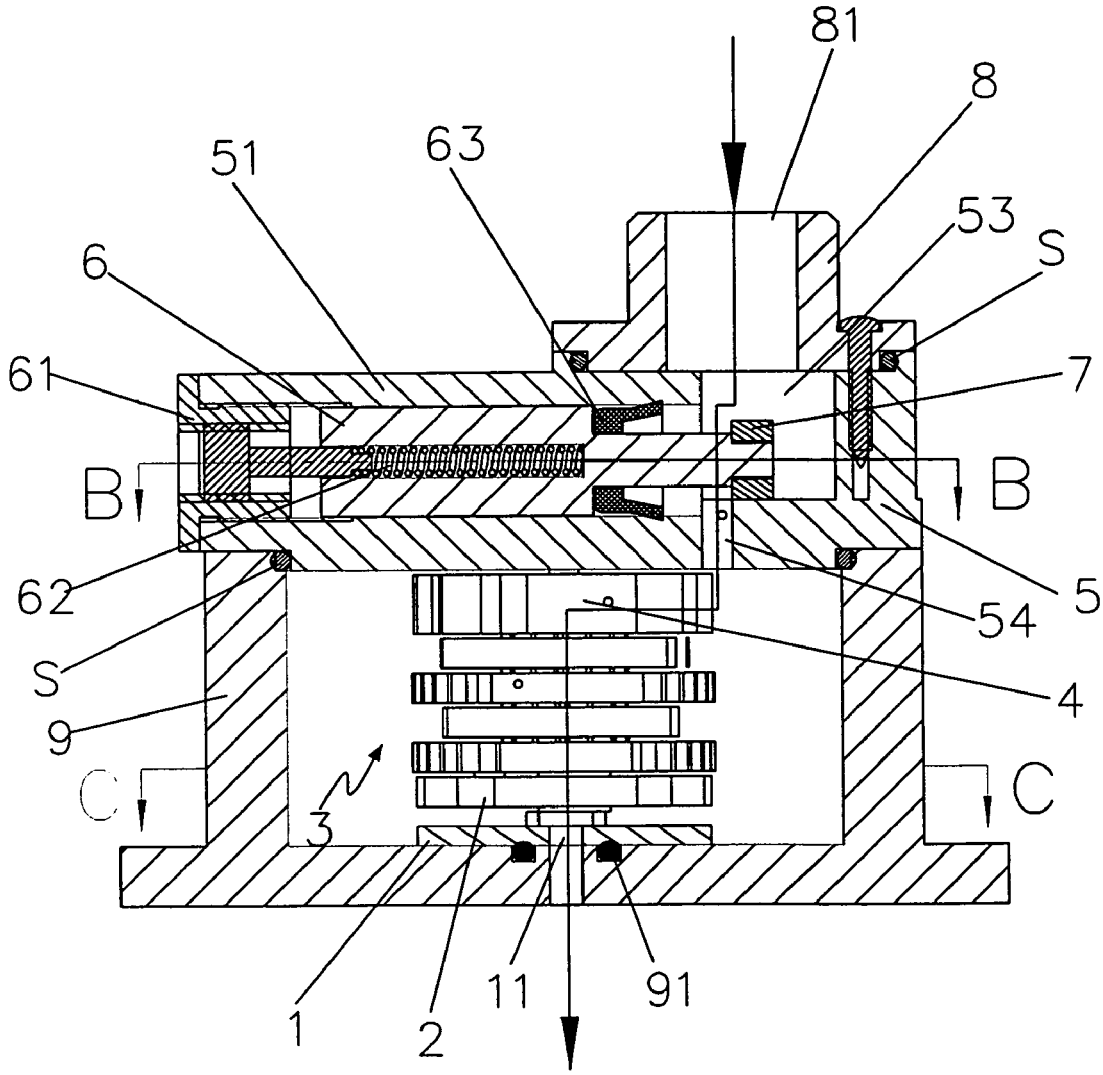
FIG. 2 is a cross-section view showing the combination in one spray mode of the present invention.
Figure 3:
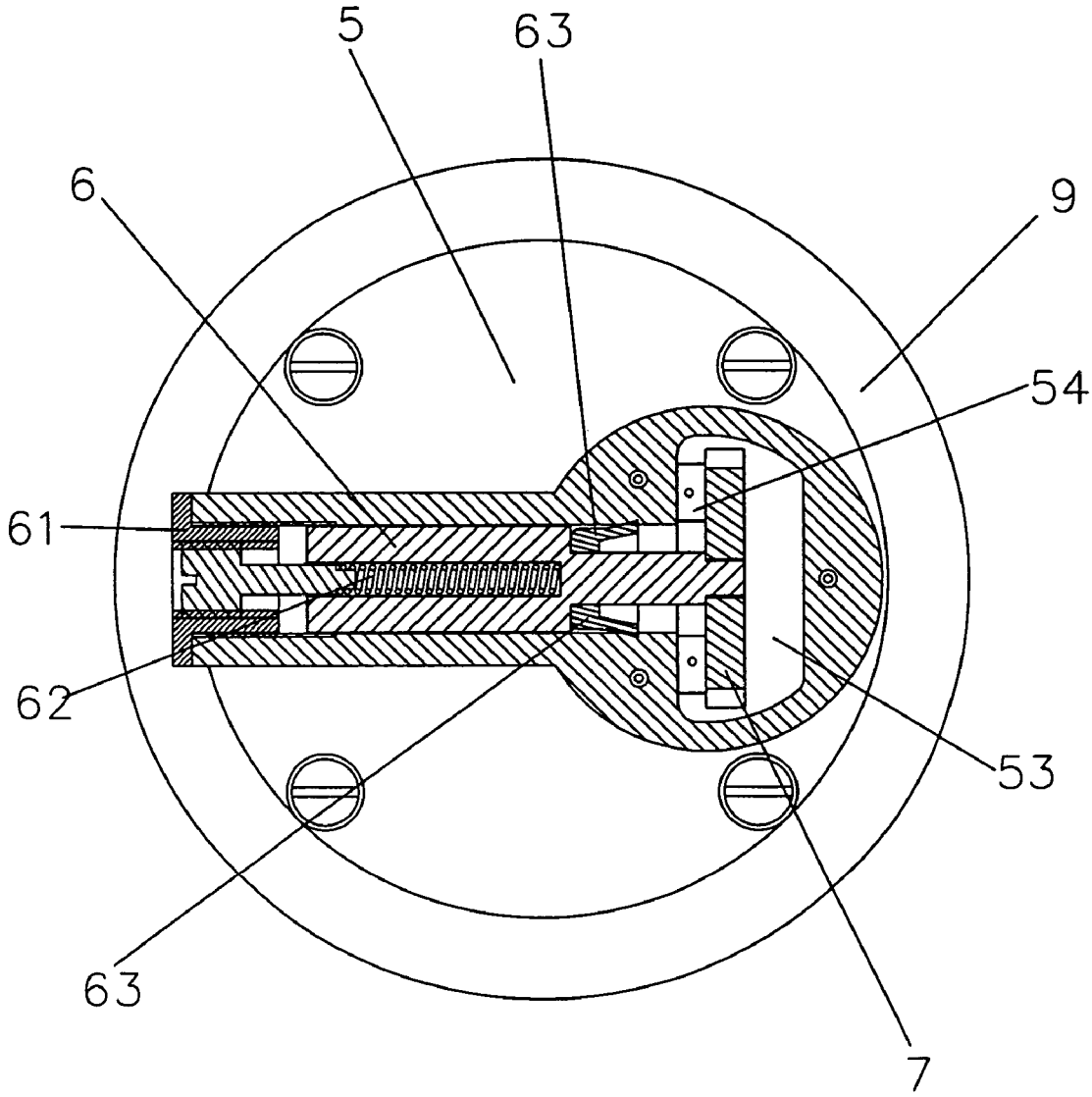
FIG. 3 is a cross-section view showing B-B section of FIG. 2.

As in normal state, referring to FIG. 2 to FIG. 4, the pressure relief valve (not shown in drawings) is turned off, the water pressure is in normal value, the blocking 7 is moved to the housing 52 following the drawbar 6 under the restoring force of the restoring spring 62 so that its bottom surface exactly blocks off the diagonal outlet 55, simultaneously open the outlet 54, in this time, water is led into top cap 8 via the inlet pipe, passing through housing 52 of the transferring stand 5 and outlet 54, the throughholes 11 of the curbing ring 1 and the coordinated mode spraying nozzles to spray out in this spray mode.

Figure 5:
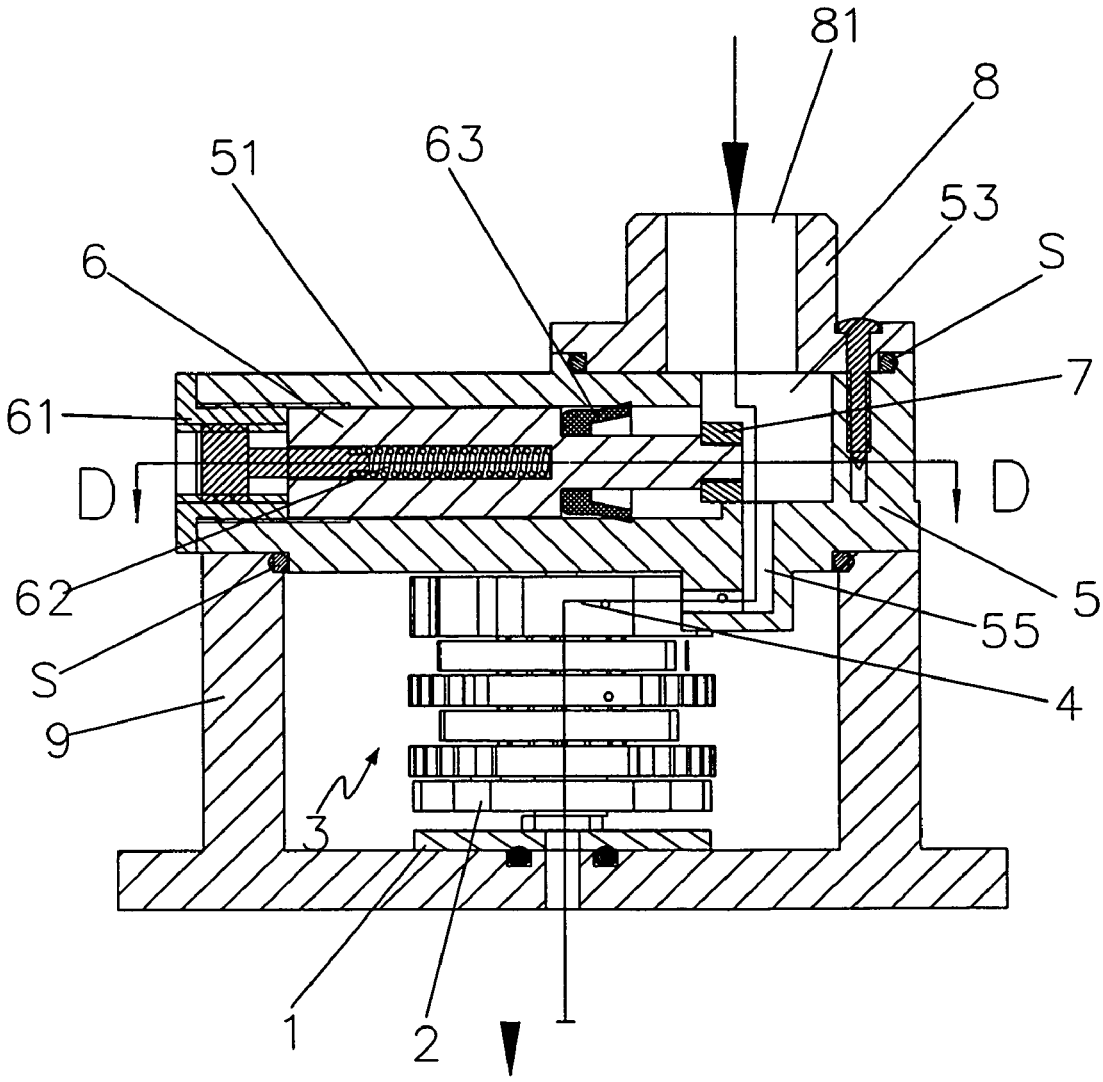
FIG. 5 is a cross-section view showing the combination in switching state of FIG. 2.
Figure 6:
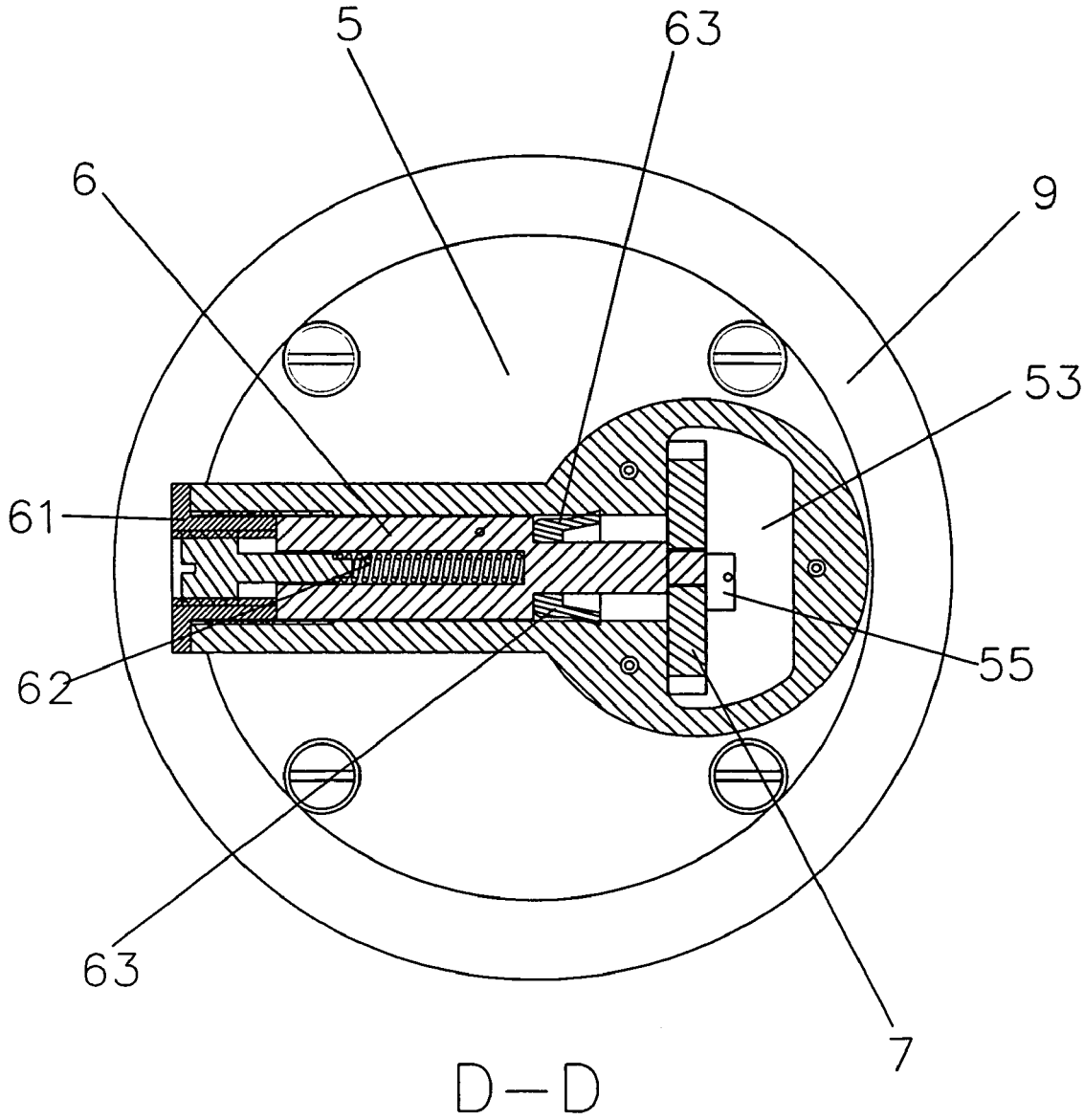
FIG. 6 is a cross-section view showing D-D section of FIG. 5.

When it comes to switching the spraying mode, referring to FIG. 5 and FIG. 6, all is needed is to press the pressure relief valve down to turn it on; the water pressure is then increased, the blocking 7 is pressed to drive the thimble 6 move to outside along the tubing 52 of the transferring stand 5 under the high water pressure, so that the bottom surface of the blocking 7 slides off the diagonal outlet 55, simultaneously blocks off the outlet 54, in this time, water is led into the top cap 8 via the inlet pipe, passing through housing 52 of the transferring stand and the diagonal outlet 55 to shoot on the blades 41 of the impeller 4 exactly to drive the impeller 4 spinning, so as to transfer to the under-driving gear set 3, via the deceleration of said underdriving gear set 3 and the indexing motion between the dialing disk 32 and the dividing disk 2, the curbing ring 1 is sequentially and periodically to open each spray mode nozzles 11 so that the shower head sprays out water in variety modes periodically until the pressure relief valve is pressed down again, (referring to FIG. 2 to FIG. 4) the high water pressure is took away, the restoring spring 62 pushes the blocking 7 via the thimble 6 to move to the housing 52 of the transferring stand 5 again, so that the bottom surface of the blocking slides off the outlet 54, simultaneously blocks off the diagonal outlet 55, the water flow is restored to the original normal state.

Figure 9:
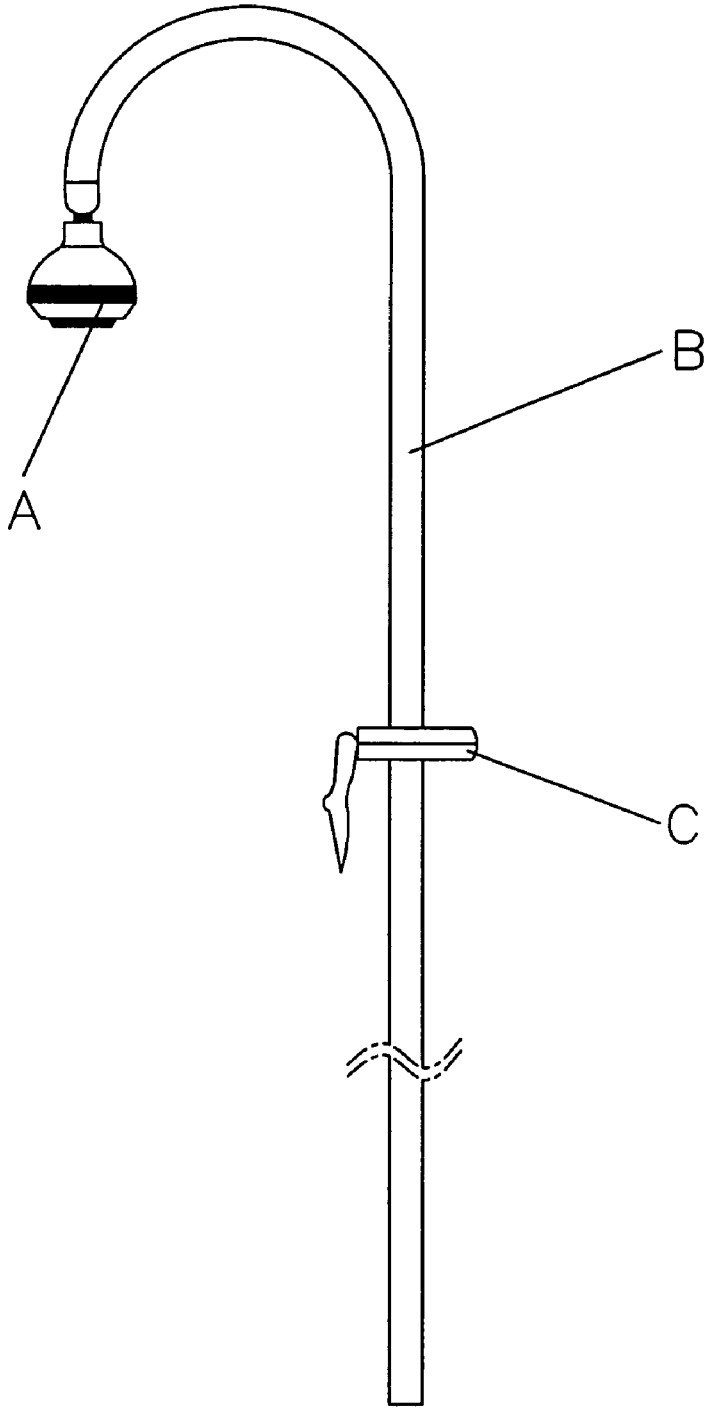
FIG. 9 is a solid view showing the exteriority in use of the present invention.

Referring to FIG. 9, it is showing a located shower head in this embodiment, in which the pressure relief valve C is mounted on the inlet pipe B at the proper position depending on necessary in site, the control style of the pressure relief valve can be varies, such like rotating, pushing down, or pulling up styles, and the pressure relief valve may be integrated with a temperature control valve. Therefore, the present invention can be used in varies shower room for facilitating to switch spray mode.

I claim:

1. A switching mechanism of a shower head body, including (i) a curbing ring, including a plurality of through-holes;

(ii) a dividing disk, (iii) an under-driving gear set, mounted to said shower head body, further including a prime shaft, a dialing disk, and a last shaft, with said dividing disk coordinating with said dialing disk (iv) an impeller, further including a plurality of blades;

(v) a transferring stand, disposed on top of said shower head body, further including a tubing, a housing, an inlet, an outlet, and a diagonal outlet, with said inlet being on the top thereof and said outlet and said diagonal outlet being at the bottom thereof, with said blades of said impeller facing to said diagonal outlet;

(vi) a drawbar, inserted into said tubing of said transferring stand, further including an end cover, a restoring spring, and a thimble, with said restoring spring being disposed inside of said end cover and said drawbar, (vii) a blocking; with the area of the bottom surface of said blocking being larger than the combined sum in sectional area of said outlet and said diagonal outlet; and (viii) a top cap, disposed on top of said inlet of said transferring stand, further including a joint port for connecting to an inlet pipe;

wherein, said curbing ring and dividing disk are fixed to said last shaft, and said impeller is mounted under said transferring stand by fixing to said prime shaft.

2. A switching mechanism of a shower head body as claimed in claim 1, wherein said end cover is secured on female threads of said tubing.

* * * * *